US006548957B1

(12) United States Patent
Kim et al.

(10) Patent No.: US 6,548,957 B1
(45) Date of Patent: Apr. 15, 2003

(54) PLASMA DISPLAY PANEL DEVICE HAVING REDUCED TURN-ON VOLTAGE AND INCREASED UV-EMISSION AND METHOD OF MANUFACTURING THE SAME

(75) Inventors: Steven Kim, Harrington Park, NJ (US); Erich E. Kunhardt, Hoboken, NJ (US); Seok-Kyun Song, Ridgefield, NJ (US); Bhum-Jae Shin, Jersey City, NJ (US); Sooho Park, Rutherford, NJ (US)

(73) Assignee: Plasmion Displays LLC, Roanoke, VA (US)

( * ) Notice: Subject to any disclaimer, the term of this patent is extended or adjusted under 35 U.S.C. 154(b) by 251 days.

(21) Appl. No.: 09/691,252

(22) Filed: Oct. 19, 2000

Related U.S. Application Data

(60) Provisional application No. 60/204,128, filed on May 15, 2000.

(51) Int. Cl.[7] ..... H01J 17/49

(52) U.S. Cl. ..... 313/585; 313/586; 313/587; 315/169.4; 445/24

(58) Field of Search ..... 313/582, 584, 313/585, 586, 587; 315/169.4; 345/60, 67; 445/24

(56) References Cited

U.S. PATENT DOCUMENTS

| | | | | |
|---|---|---|---|---|
| 3,983,445 A | | 9/1976 | Yasuda et al. | |
| 4,005,402 A | | 1/1977 | Amano | |
| 4,164,678 A | | 8/1979 | Biazzo et al. | |
| 4,728,864 A | | 3/1988 | Dick | |
| 5,674,553 A | | 10/1997 | Shinoda et al. | |
| 5,818,168 A | | 10/1998 | Ushifusa et al. | |
| 5,872,426 A | * | 2/1999 | Kunhardt et al. | 313/582 |
| 6,160,348 A | * | 12/2000 | Choi | 313/584 |
| 6,255,777 B1 | * | 7/2001 | Kim et al. | 313/582 |

* cited by examiner

*Primary Examiner*—Joan Pendegrass
(74) *Attorney, Agent, or Firm*—Morgan, Lewis & Bockius LLP

(57) ABSTRACT

The present invention discloses a plasma display panel device and a method of fabricating the same including first and second substrates, a first electrode on the first substrate, a second electrode on the second substrate, a dielectric layer on the second substrate including the second electrode, a plurality of third electrodes completely buried in the dielectric layer, a plurality of barrier ribs connecting the first and second substrates formed on the second substrate, a UV-visible conversion layer on the second substrate including the second substrate between the barrier ribs, and a discharge chamber where discharge occurs between the first and second substrates, wherein the discharge chamber faces toward the second electrode through a single row of one or more capillaries formed in the dielectric layer.

56 Claims, 19 Drawing Sheets

PLASMA DISPLAY PANEL DEVICE HAVING REDUCED TURN-ON VOLTAGE AND INCREASED UV-EMISSION AND METHOD OF MANUFACTURING THE SAME

This application claims the benefit of a provisional application, entitled "High Efficiency Plasma Display Panel Device and Method of Fabricating the Same," which was filed on May 15, 2000, and assigned Provisional Application No. 60/204,128, which is hereby incorporated by reference.

BACKGROUND OF THE INVENTION

1. Field of the Invention

The present invention relates to a plasma display device, and more particularly, to a high efficiency plasma display panel device and method of fabricating the same. Although the present invention is suitable for a wide scope of applications, it is particularly suitable for the plasma display panel device for reducing a turn-on voltage and significantly increasing a UV-emission without increasing a discharge operation voltage.

2. Discussion of the Related Art

Plasma display panel(PDP) devices use gas discharges to convert electric energy into light. Each pixel in a PDP device corresponds to a single gas-discharge site and the light emitted by each pixel is electronically controlled by the video signal that represents the image.

The unique advantage of plasma displays is that they combine a large screen size with a very thin display panel. Generally, PDP is the choice for large size display devices, typically larger than 40" diagonal.

A DC operating PDP device has advantages of high controlled brightness and a fast response time. However, the structure is complicated. Further, a life time of the device is limited by current limiting resistors since the DC PDP device includes resistors. On the other hand, an AC operating PDP device has a simpler structure and higher reliability than those of the DC PDP device.

Most of the conventional AC PDP devices utilizes an AC barrier type discharge as disclosed in U.S. Pat. No. 5,674,553. As shown in FIG. 1 of the present application, a conventional plasma display panel device includes a front glass substrate 11 on the side of the display surface H, a pair of display electrodes X and Y, a dielectric layer 17, a protecting layer 18 of MgO, a substrate 21 on the background side, a plurality of barriers extending vertically and defining the discharge spaces 30 by contacting the top thereof with the protecting layer 18, address electrodes 22 disposed between the barriers 29, and phosphor layers 28R, 28G, and 28B.

However, the conventional AC PDP device has low density plasma, resulting in a low brightness and a slow response time due to a charging time on the dielectric wall. As a result, gray scale problems occur in the display device. Further, the deposition of MgO films on the dielectric layer to enhance secondary electron emission causes high manufacturing cost and limits the life time of the device.

SUMMARY OF THE INVENTION

Accordingly, the present invention is directed to a high efficiency plasma display panel device and method of fabricating the same that substantially obviates one or more of problems due to limitations and disadvantages of the related art.

An object of the present invention is to provide an improved plasma display panel device.

Another object of the present invention is to provide a plasma display panel device having a high brightness and a fast response time.

Another objection of the present invention is to provide a plasma display panel device operated with a low driving voltage.

A further object of the present invention is to provide a plasma display panel device having a simpler structure.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel device includes first and second substrates, a first electrode on the first substrate, a second electrode on the second substrate, a dielectric layer on the second substrate including the second electrode, a plurality of third electrodes completely buried in the dielectric layer, a plurality of barrier ribs connecting the first and second substrates formed on the second substrate, a UV-visible conversion layer on the second substrate including the second substrate between the barrier ribs, and a discharge chamber where discharge occurs between the first and second substrates, wherein the discharge chamber faces toward the second electrode through a single row of one or more capillaries formed in the dielectric layer.

In another aspect of the present invention, a plasma display panel device includes first and second substrates, a first electrode on the first substrate, a second electrode on the second substrate, a dielectric layer on the second substrate including the second electrode, a plurality of third electrodes on the dielectric layer, a discharge chamber where discharge occurs between the first and second substrates, wherein the discharge chamber is exposed to a single row of one or more capillaries formed in the dielectric layer, and a protective layer on the third electrodes and the dielectric layer including on a portion of the dielectric layer in the capillaries.

In another aspect of the present invention, a plasma display panel device includes a plurality of pixels, each of the pixels having a discharge chamber gas pressure therein, and an electrode supplying a driving voltage to one of the pixels, wherein the driving voltage decreases when the discharge chamber gas pressure increases in the range of 300 to 760 Torr.

In another aspect of the present invention, a transmissive type plasma display panel device includes first and second substrates, the second substrate being a viewing panel, a first electrode on the first substrate, a UV-visible conversion layer on the second substrate, a dielectric layer on the first electrode, a plurality of second electrodes completely buried in the dielectric layer, and a discharge chamber where discharge occurs between the first and second substrates, wherein the discharge chamber faces toward the first electrode through a single row of one or more capillaries formed in the dielectric layer.

In a further aspect of the present invention, a method of fabricating a plasma display panel device having first and second substrates includes the steps of forming a first electrode on the first substrate, forming a second electrode on the second substrate, forming a first dielectric layer on the second substrate including the second electrode, forming a plurality of third electrodes on the first dielectric layer, forming a second dielectric layer on the first dielectric layer including the third electrodes, forming a single row of one or more capillaries in the first and second dielectric layers, and forming a plurality of barrier ribs on the first substrate connecting the first and second substrates, thereby forming a discharge chamber between the first and second substrates defined by the barrier ribs.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A capillary type PDP device of the present invention utilizes a new type of electrical discharge in gas in which high density plasma is produced. Plasma is generated in the capillary. The number and the dimension of the capillaries may be varied to optimize discharge characteristics.

Figure 18A:
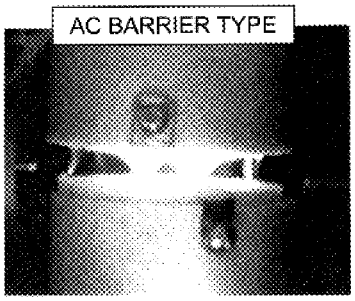
FIG. 18A is a photograph illustrating a plasma discharge in the conventional AC barrier type PDP device.
Figure 18B:
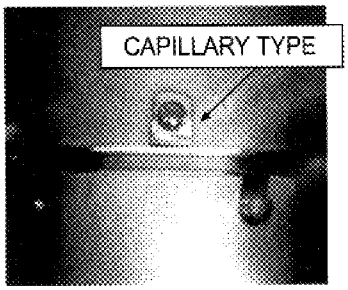
FIGS. 18B and 18C are photographs illustrating a plasma discharge in the capillary type PDP device of the present invention.
Figure 18C:
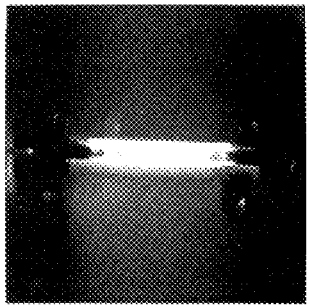

FIG. 18A illustrates an intensity of the plasma discharge of the conventional AC barrier type PDP device. FIGS. 18B and 18C illustrate an intensity of the plasma discharge of the capillary type PDP device of the present invention. As shown in FIGS. 18A to 18C, a plasma jet emanating from the capillaries is clearly visible and brighter than that of the conventional AC barrier type PDP device. Also, the intensity of the discharge of the capillary type PDP device of the present invention is significantly larger than that of the conventional AC barrier discharge under the same condition.

Figure 19A:
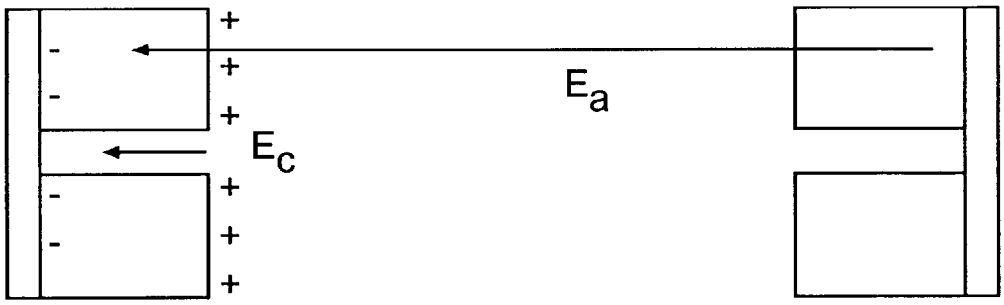
FIGS. 19A to 19C are schematic views illustrating a generation of a plasma discharge according to the present invention.
Figure 19B:
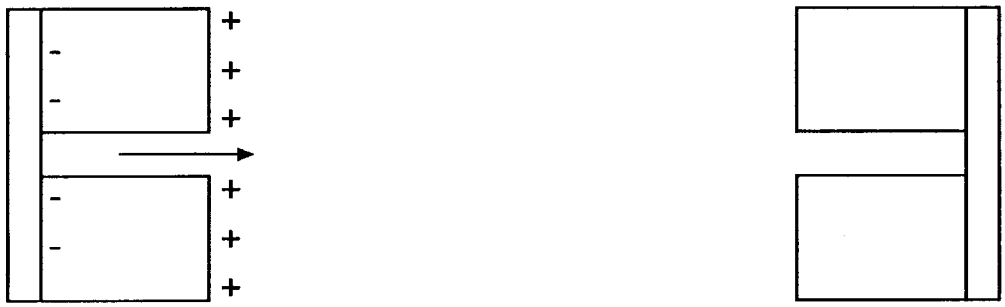
Figure 19C:
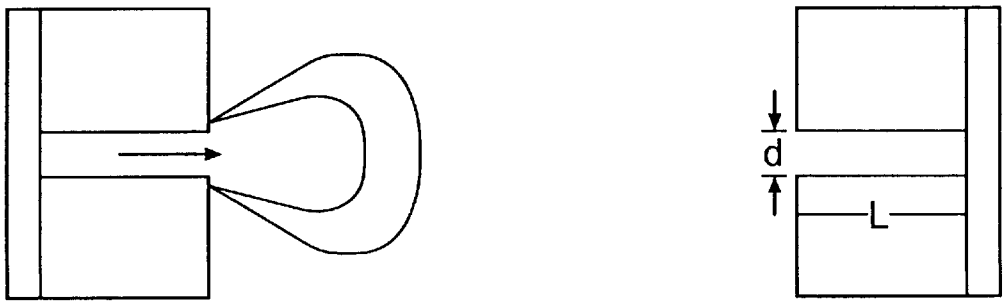

FIGS. 19A to 19C schematically illustrate the features of the capillary type PDP device of the present invention. FIG. 19A shows a field $E_c$ inside of the capillary generating a high field discharge and an applied electrode field $E_a$. High density plasma in the capillary emerges from the end of the capillary into the discharge chamber, serving as an electrode for the discharge chamber. The field inside of the capillary does not collapse after forming a streamer discharge. This is due to a high electron-ion recombination at the wall requiring a large production rate on the axis (and therefore a high field) in order to sustain the current. FIG. 19C illustrates that a double layer of electric field exist at the interface of the capillary and the main discharge chamber. By selecting a ratio of the diameter d of the capillary to the length of the capillary L, a steady state high density plasma discharge can be sustained in the discharge chamber.

Figure 1:
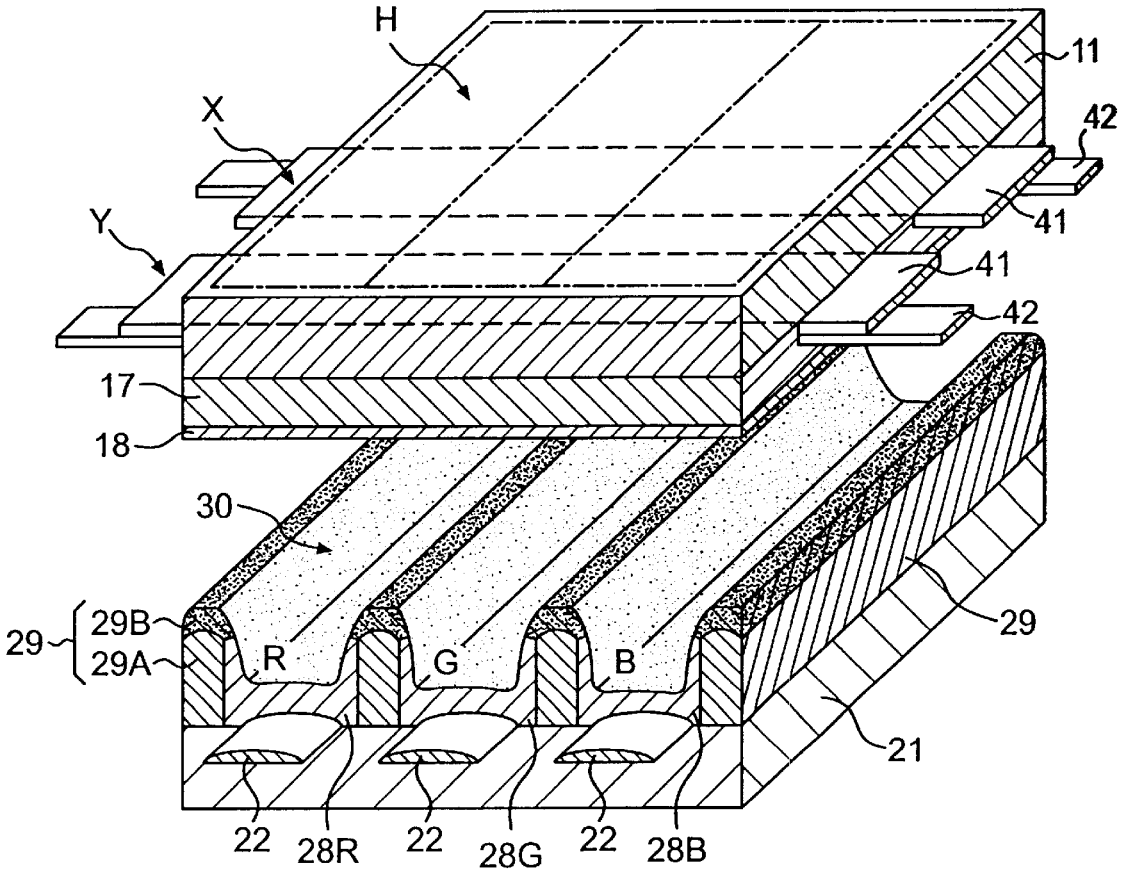
FIG. 1 PRIOR ART
FIG. 1 is a perspective view of the conventional AC barrier type plasma display panel device.
Figure 2:
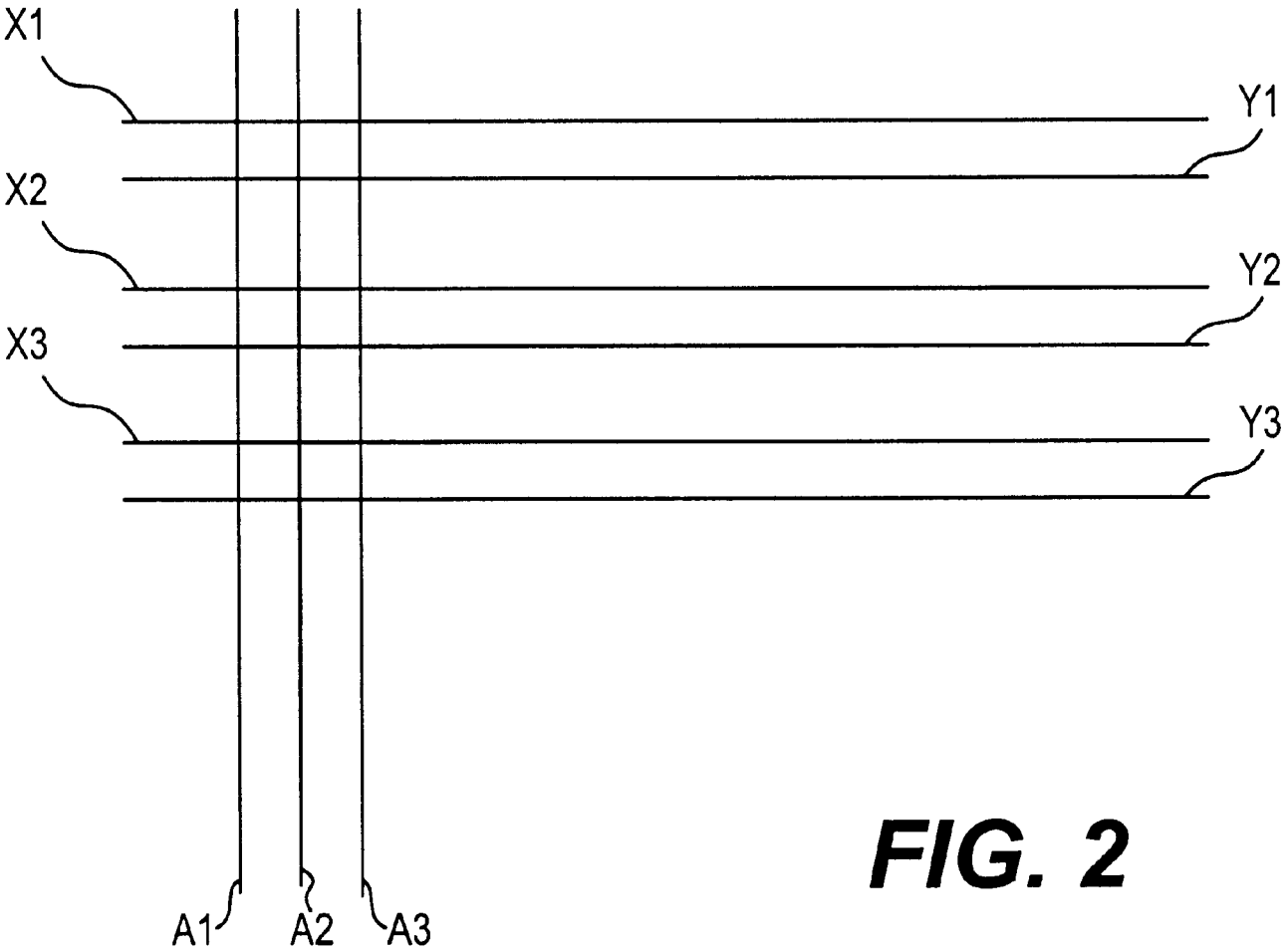
FIG. 2 is a schematic view of a front substrate of a plasma display panel device of the present invention.

A plasma display panel device according to the present invention will be described as follows. As shown in FIG. 2, a front glass substrate located on a viewing side of the PDP device includes a plurality of address electrodes A1, A2, . . . , and An, and a plurality of sustain electrodes X1, Y1, X2, Y2, . . . , Xn, and Yn. For example, the address electrodes and the sustain electrodes are formed of metal, such as indium tin oxide (ITO). Each of the address electrodes and the sustain electrodes vertically cross each other.

Figure 3:
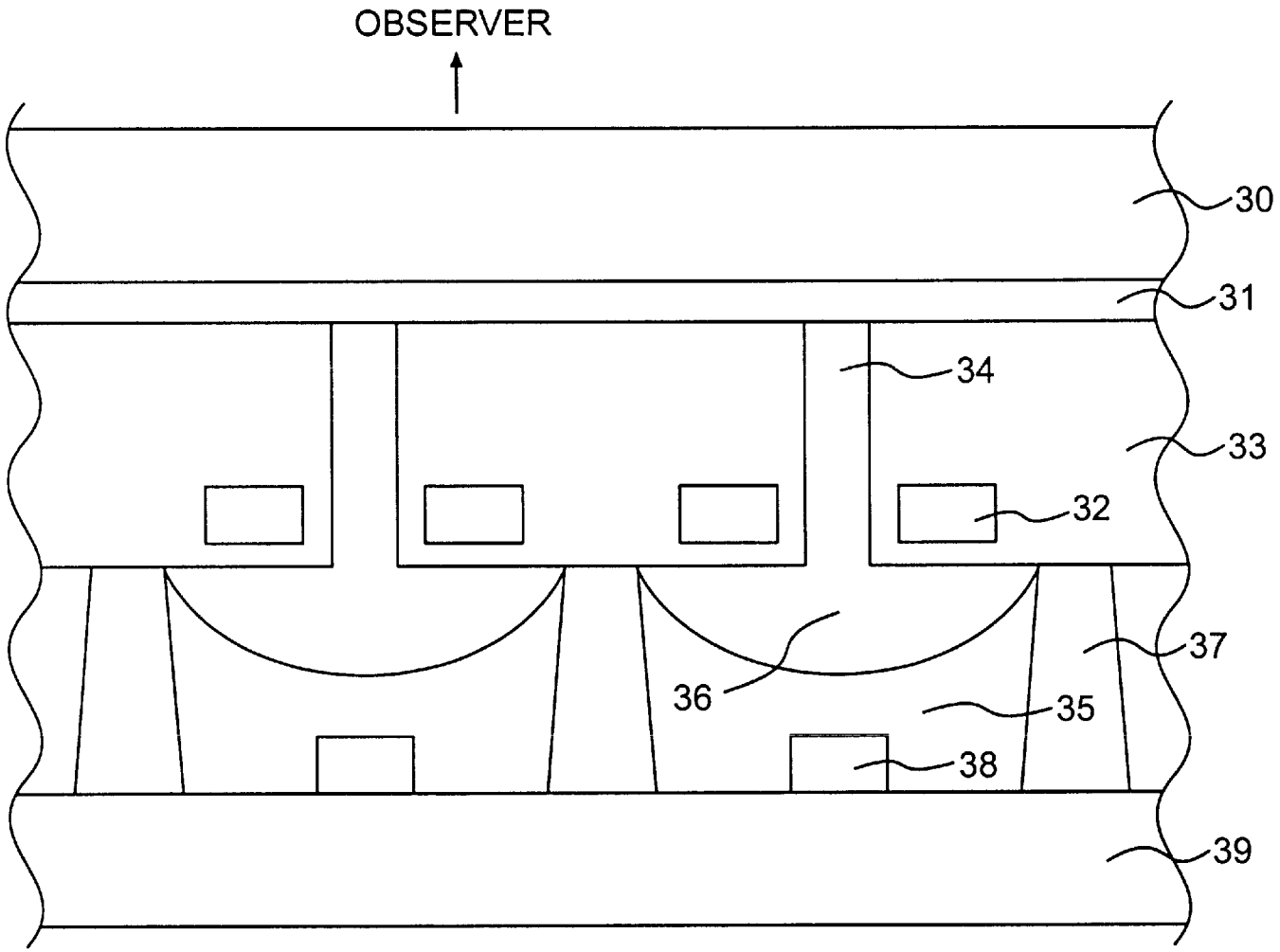
FIG. 3 is a cross-sectional view of the plasma display panel device according to the present invention.
Figure 4:
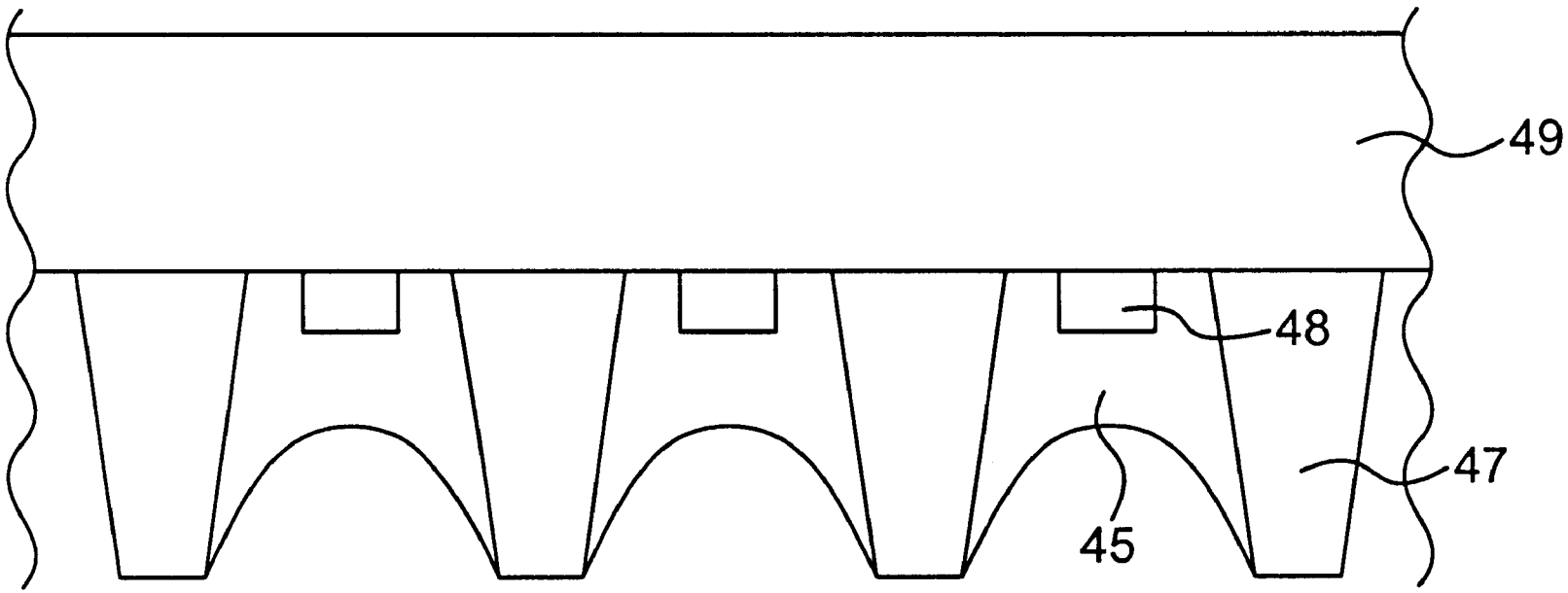
FIG. 4 is a cross-sectional view of a rear substrate of the plasma display panel device according to the present invention.

FIG. 3 illustrates a cross-sectional view of the PDP device while FIG. 4 is a cross-sectional view showing only a rear substrate of the PDP device of the present invention.

Specifically, FIG. 3 shows that a pair of barrier ribs 37 connect a rear substrate 39 and a front substrate 30. A discharge chamber 36 is thus formed between the front substrate 30 and the rear substrate 39 defined by the barrier ribs 37. Also, a UV-visible photon conversion layer 35 is formed between the barrier ribs 37 on the rear substrate including the electrode 38. Typically, the discharge chamber 36 is filled with an inert gas mixture such as Xenon (Xe) to generate a UV emission. On the front substrate 30, a first electrode 31 is formed for biasing the field to the viewing direction, thereby more effectively improving the images on the viewing panel. About −100~250 V is applied as a biasing voltage. A dielectric layer 33 is formed on the first electrode 31. In each pixel, at least one capillary 34 is formed in the dielectric layer 33, so that the first electrode 31 is exposed to the discharge chamber 36. A pair of second electrodes 32 are formed in the dielectric layer 33 in the vicinity of each capillary. A sustain voltage smaller than a discharge operation voltage is applied to the second electrodes 32. For example, the sustain voltage is in the range of 160~200 V and the address voltage is between 50 and 250 V. A third electrode 38 on the rear substrate 39 acts as an address electrode. An address voltage is applied only to the third electrode 38 located in the chambers to be turned on.

Similar to FIG. 3, an address electrode 48 is formed on a rear substrate 49 as shown in FIG. 4. A pair of barrier ribs 47 are formed on the rear substrate 49. A UV-visible photon conversion layer 45 is formed between the barrier ribs 47 on the rear substrate including the address electrode 48.

Figure 5:
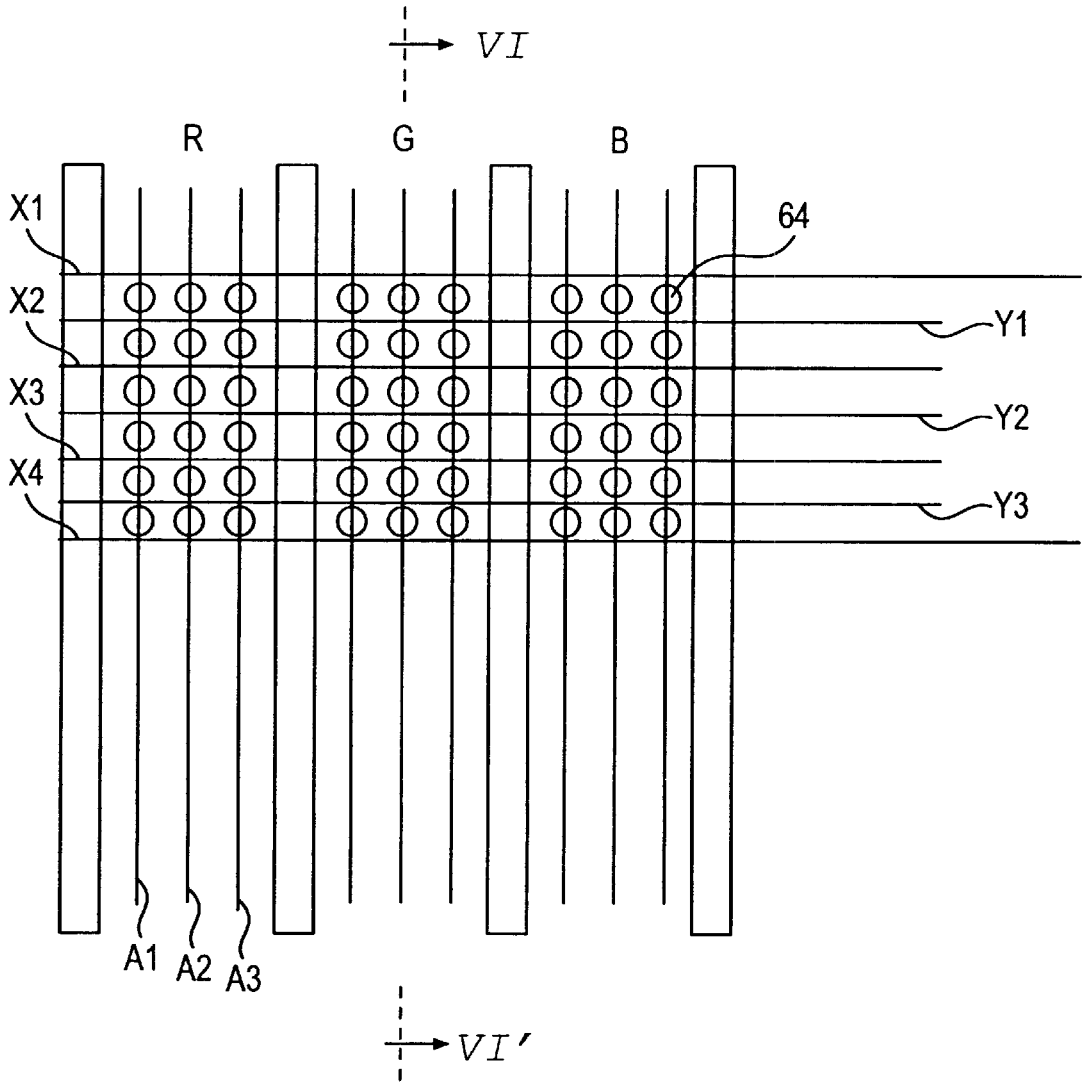
FIG. 5 is a schematic view of a front substrate of a plasma display panel device according to a first embodiment of the present invention.
Figure 6:
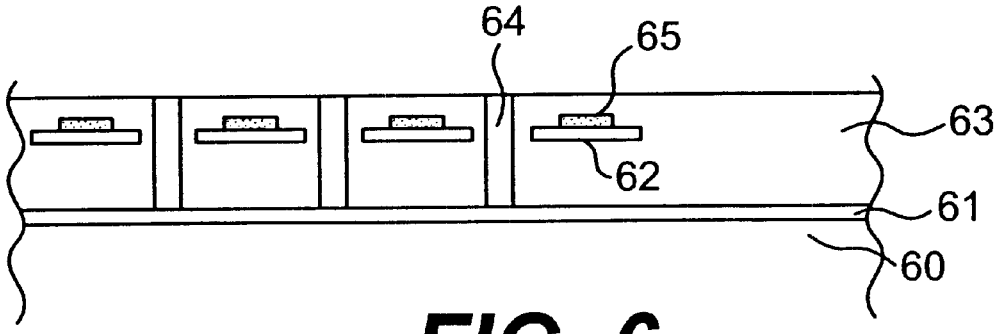
FIG. 6 is a cross-sectional view of a front substrate of the plasma display panel device according to the first embodiment of the present invention.
Figure 21:
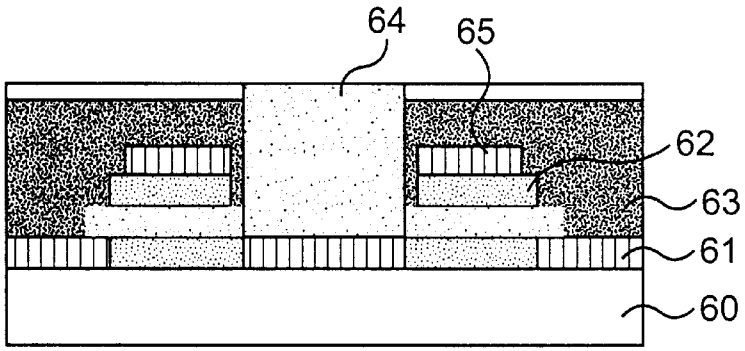
FIG. 21 is a cross-sectional view of the rear substrate along with the line XXI–XXI' in FIG. 20 of the present invention.
Figure 20:
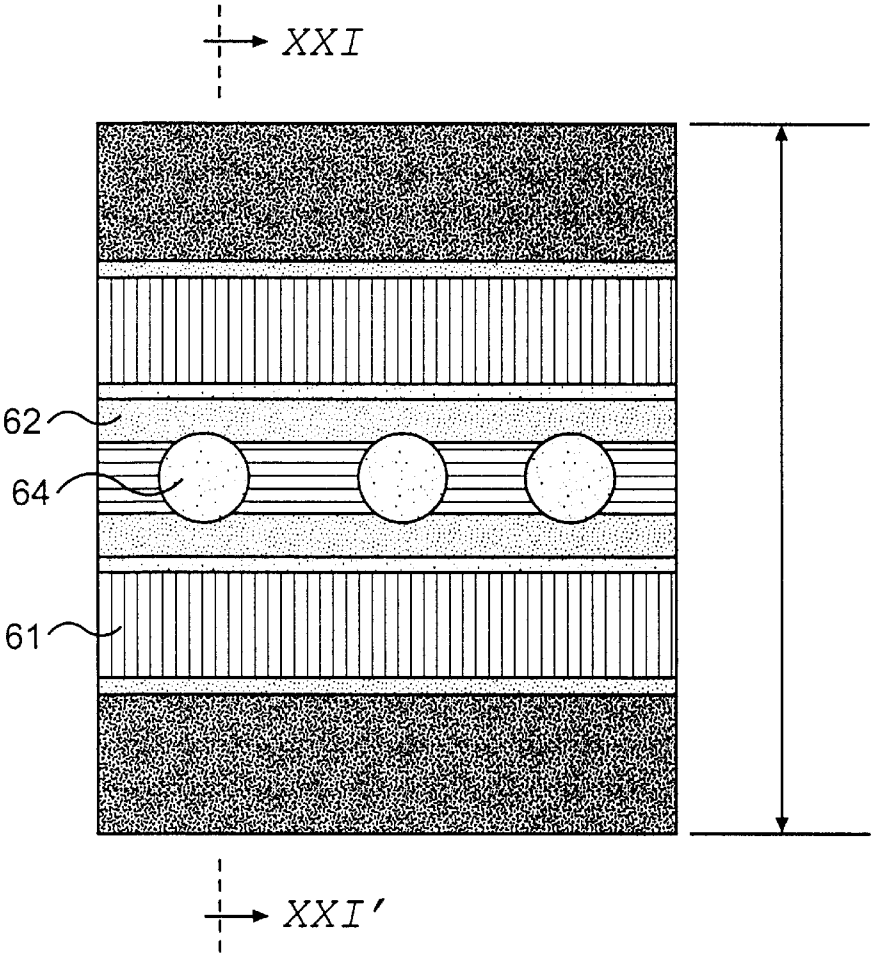
FIG. 20 is a top view of a rear substrate according to the present invention.

FIGS. 5 and 6 respectively illustrate a top view and a cross-sectional view of a front substrate of a PDP device according to a first embodiment of the present invention. As shown in FIGS. 5 and 6, a first electrode 61 is formed on a front glass substrate 60 as a biasing electrode. For example, a transparent dielectric layer 63, such as lead oxide (PbO) glass, is formed on the first electrode 61 including the front substrate 60. A plurality of second electrodes 62, made of ITO, are formed in the dielectric layer 63 as sustain electrodes. A third electrode 65, formed of silver (Ag), may be formed on each of the plurality of electrodes 62, as a bus electrode. The third electrode has a line width of about 50 $\mu$m. At least one capillary 64 is formed in the dielectric layer 63 to expose the first electrode 61 to the discharge chamber (not shown). Thus, a steady state high density UV emission is obtained in the discharge chamber. A typical dimension of a cross-section of the capillary is about 10 to 100 $\mu$m. The capillaries are formed in the dielectric layer between each of the plurality of second electrodes 62. Further, up to three capillaries may be formed in each pixel, as shown in FIG. 5. In this embodiment, the capillaries are formed in a single row, as shown in FIGS. 20 and 21.

Figure 7:
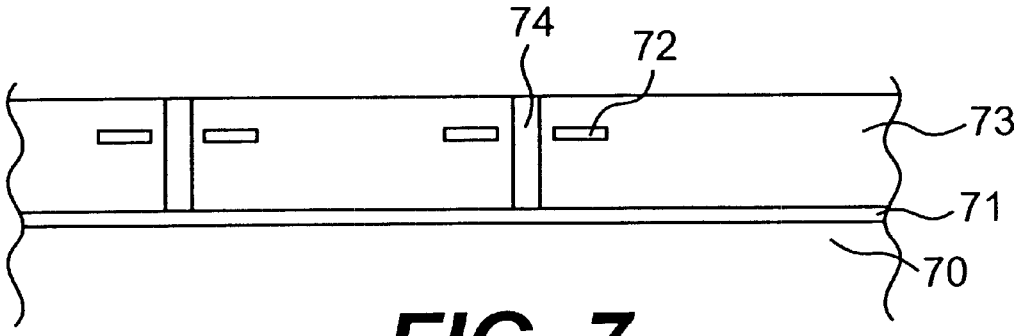
FIG. 7 is a cross-sectional view of a front substrate of the plasma display panel device according to a second embodiment of the present invention.

FIG. 7 illustrates a cross-sectional view of a front substrate of a PDP device according to a second embodiment of the present invention. As shown in FIG. 7, a PDP device of the second embodiment of the present invention has the similar structure as that of the first embodiment of the present invention, except for the location of the capillaries 74. In this embodiment, the capillaries 74 are formed in every other portion between the plurality of second electrodes in the dielectric layer.

Figure 8:
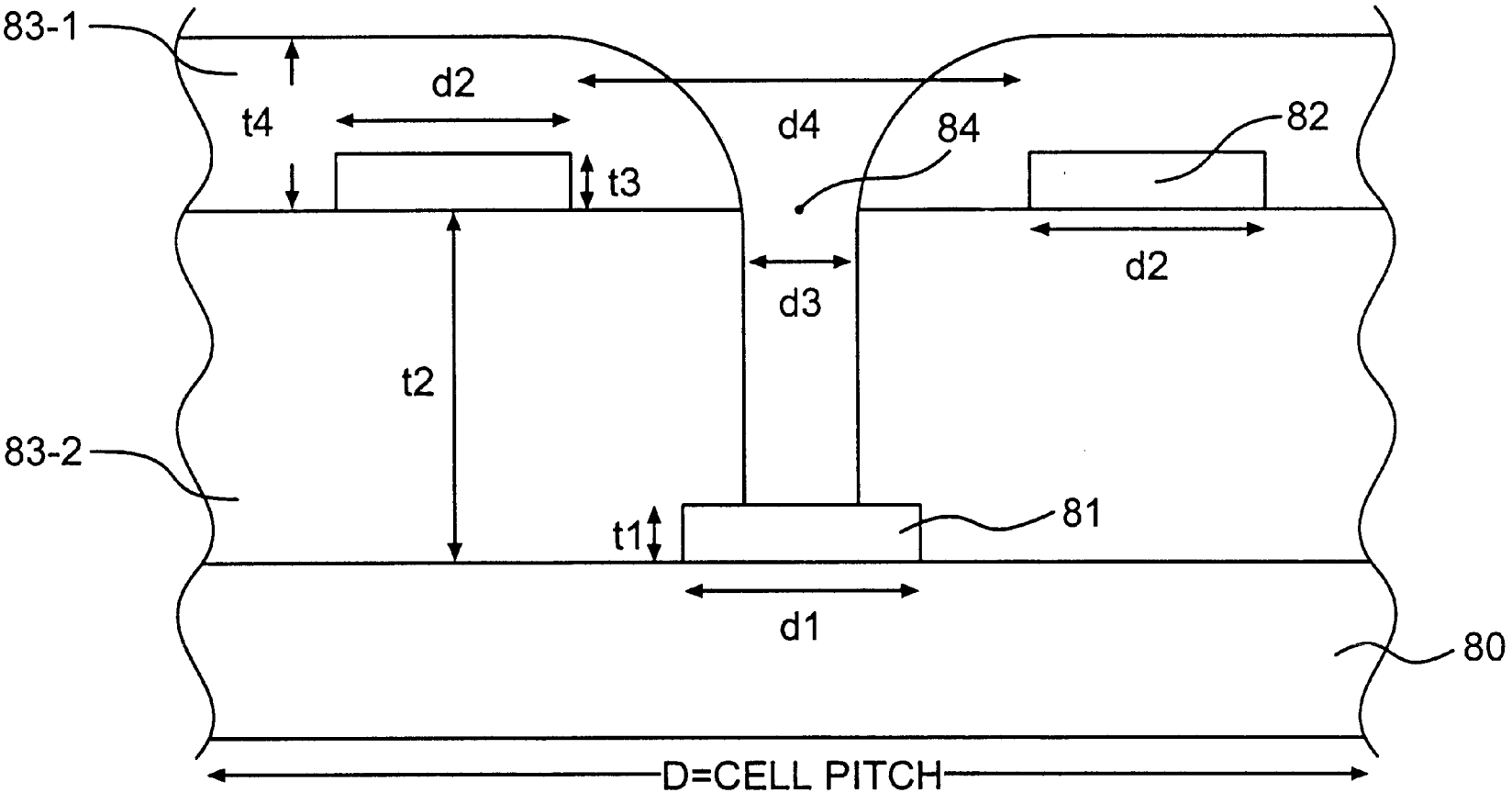
FIG. 8 is a cross-sectional view of a plasma display panel device according to a third embodiment of the present invention.

FIG. 8 illustrates a cross-sectional view of a front substrate of a PDP device according to a third embodiment of the present invention. As shown in FIG. 8, in the third embodiment of the present invention, the edge of the dielectric layer 83 forms a curvature. Generally, an amount of charges is determined by the thickness of the dielectric layer on the sustain electrode. In turns, the current is limited by the amount of charges. The curvature reduces a thickness of the dielectric concentrated on the discharge surface. Thus, more uniform discharge may be generated on the surface. In addition, since the opening of the capillary may be larger than the diameter, the amount of discharge volume is maximized by diffusing the discharge from the opening. Also, performance of PDP device can be optimized by adjusting the following various parameters shown in FIG. 8: d1 (width of address electrode 81), d2 (width of sustain electrode 82), d3 (diameter of capillary 84), d4 (gap between two adjacent sustain electrodes 82), t1 (thickness of address electrode 81), t2 (thickness of lower dielectric layer 83-2), t3 (thickness of sustain electrode 82), and t4 (thickness of upper dielectric layer 83-1). For example, a width of the address electrode (d1) is preferably in the range of 0.01 $\mu$m to the unit cell pitch (D) of 1000 $\mu$m. A width of the sustain electrode (d2) is between 0.01 $\mu$m and (D-d4)/2. A diameter of the capillary (d3) is between 10 and 500 $\mu$m. A gap between two adjacent sustain electrodes (d4) is between d3 and (D2xd2). A thickness of the address electrode is preferably in the range of 0.01 $\mu$m to 20 $\mu$m. However, a thickness of the lower dielectric layer (t2), a thickness of the sustain electrode (t3), and a thickness of the upper dielectric layer (t3) may be arbitrarily selected.

Figure 9:
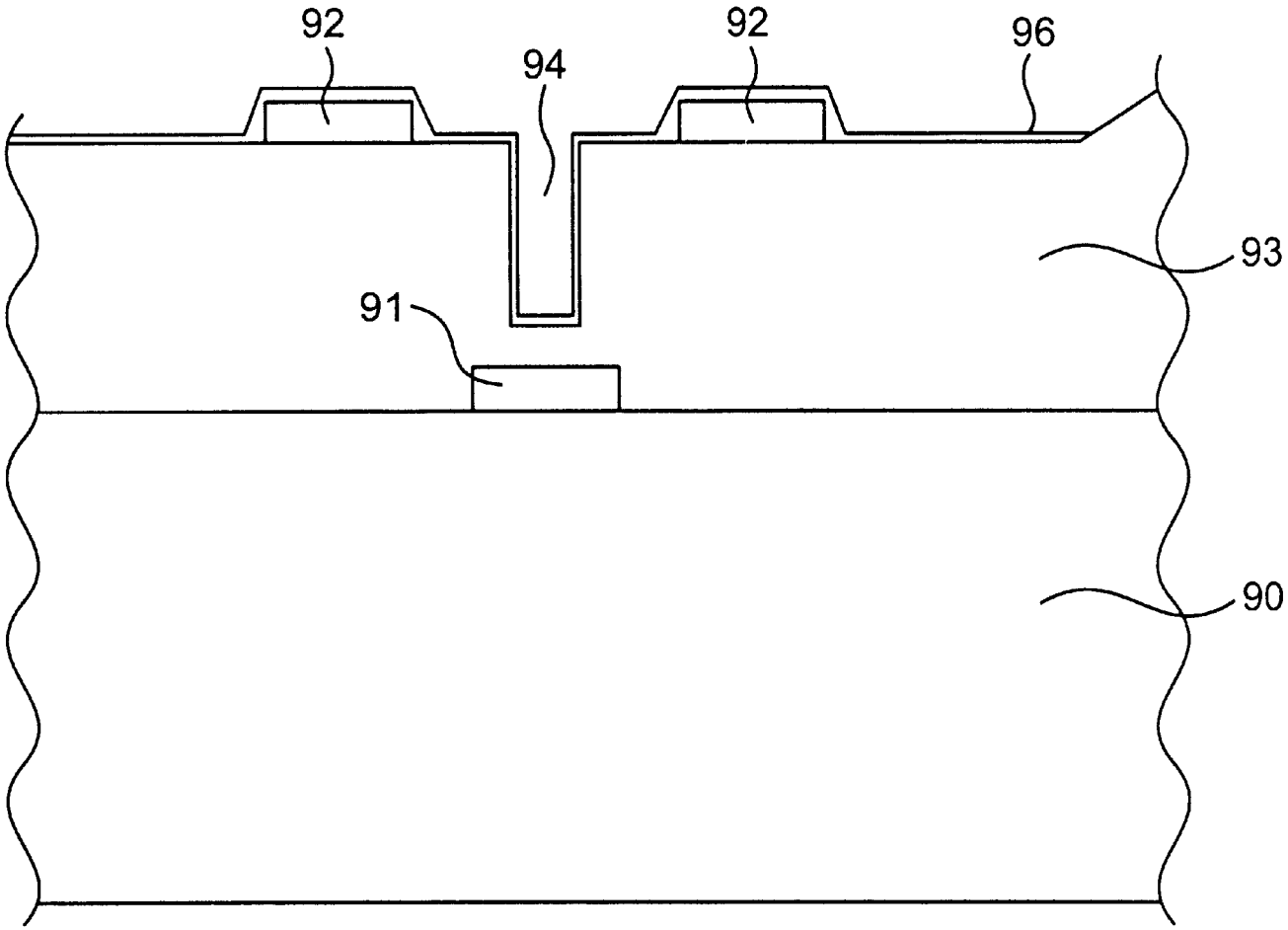
FIG. 9 is a cross-sectional view of a plasma display panel device according to a fourth embodiment of the present invention.

FIG. 9 illustrates a cross-sectional view of a front substrate of a PDP device according to a fourth embodiment of the present invention. As shown in FIG. 9, a first electrode 91 for addressing each pixel is formed on a front glass substrate 90. A transparent dielectric layer 93, such as PbO glass, is formed on the front glass substrate 90 including the first electrode 91. At least one capillary 94 is formed in the dielectric layer 93. In this embodiment, the first electrode 91 is not exposed to the discharge chamber through the capillary 94. A plurality of second electrodes 92 for applying a sustain voltage are formed on the dielectric layer 93. Further, a protective layer 96 formed of a magnesium oxide (MgO), for example, may be formed on the dielectric layer 93 including the second electrodes 92 and the capillary 94.

Figure 10:
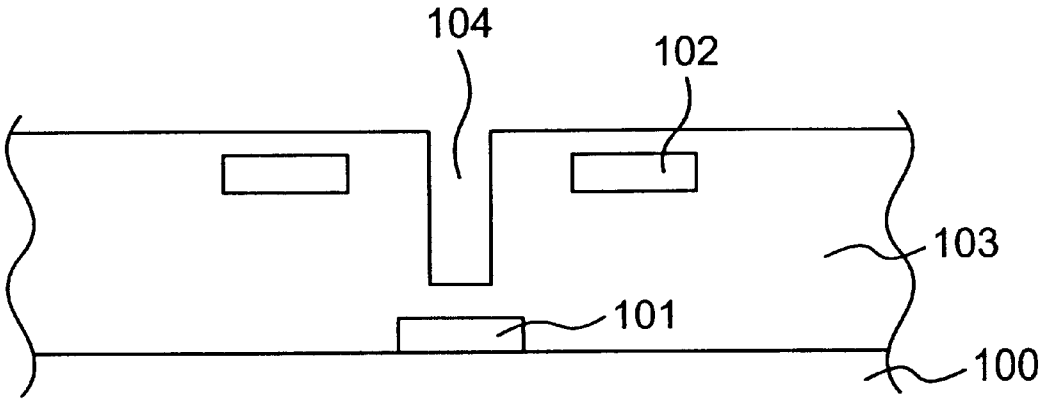
FIG. 10 is a cross-sectional view of a plasma display panel device according to a fifth embodiment of the present invention.

FIG. 10 is a cross-sectional view of a front substrate of a PDP device according to a fifth embodiment of the present invention. As shown in FIG. 10, a first electrode 101 for addressing the pixel is formed on a front glass substrate 100. A transparent dielectric layer 103, formed of PbO glass, is formed on the front substrate 100 including the first electrode 101. A plurality of second electrodes 102 are formed in the dielectric layer 103. Unlike the fourth embodiment shown in FIG. 9, the sustain electrodes are completely buried in the dielectric layer. At least one capillary 104 is formed in the dielectric layer 103. Similar to the fourth embodiment, the first electrode 101 is not exposed to the discharge chamber (not shown).

Figure 11:
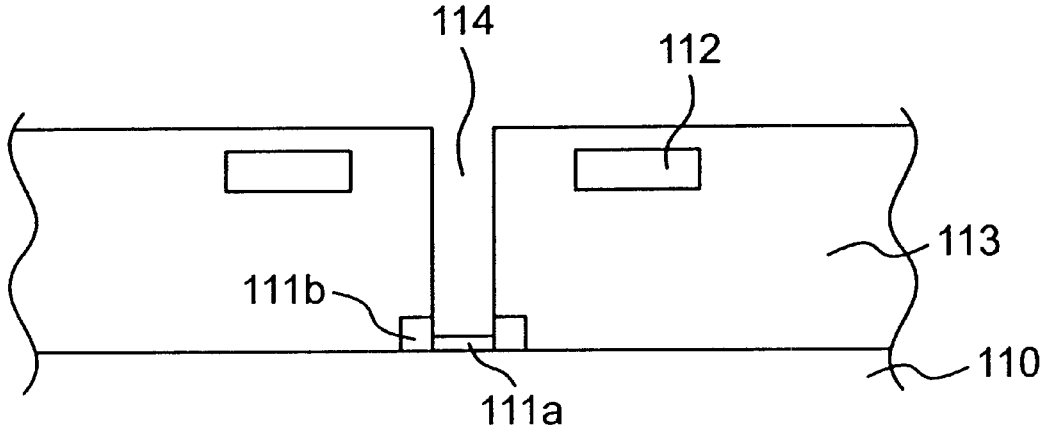
FIG. 11 is a cross-sectional view of a plasma display panel device according to a sixth embodiment of the present invention.

FIG. 11 illustrates a cross-sectional view of a front substrate of a PDP device according to a sixth embodiment of the present invention. The sixth embodiment is similar to the fifth embodiment except for the structure of the address electrode. The address electrode consists of first and second address electrodes 111*a* and 111*b*. The first address electrodes 111*a* is formed on a front glass substrate 110 within a capillary 114 and is exposed to the discharge chamber (not shown) through the capillary 114. The second address electrode 111*b* surrounding a portion of the capillary 114 and the first address electrode 111*a* are formed on the front glass substrate 110 and in the dielectric layer 113.

A method of fabricating a plasma display panel device according to the present invention is now explained. As an example, a method of fabricating a plasma display panel device of the present invention is described with reference to FIGS. 12A to 12E.

Figure 12A:
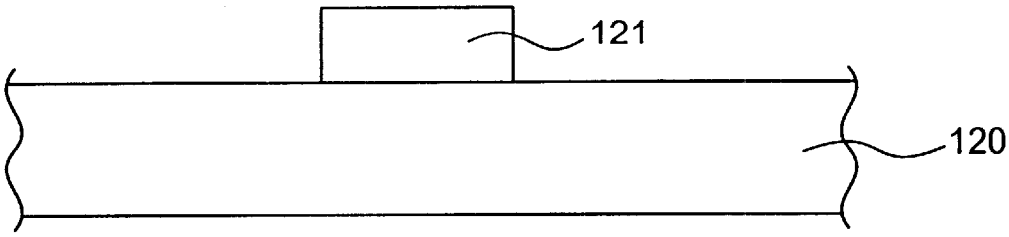
FIGS. 12A to 12E are schematic views of a method of fabricating the plasma display panel device according to the present invention.
Figure 12B:
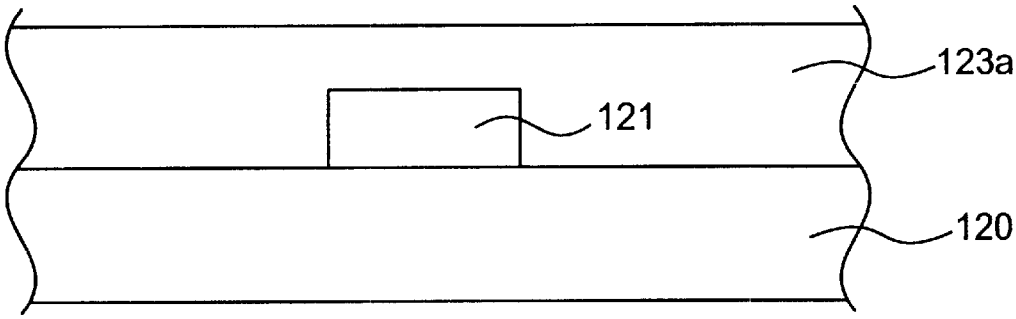
Figure 12C:
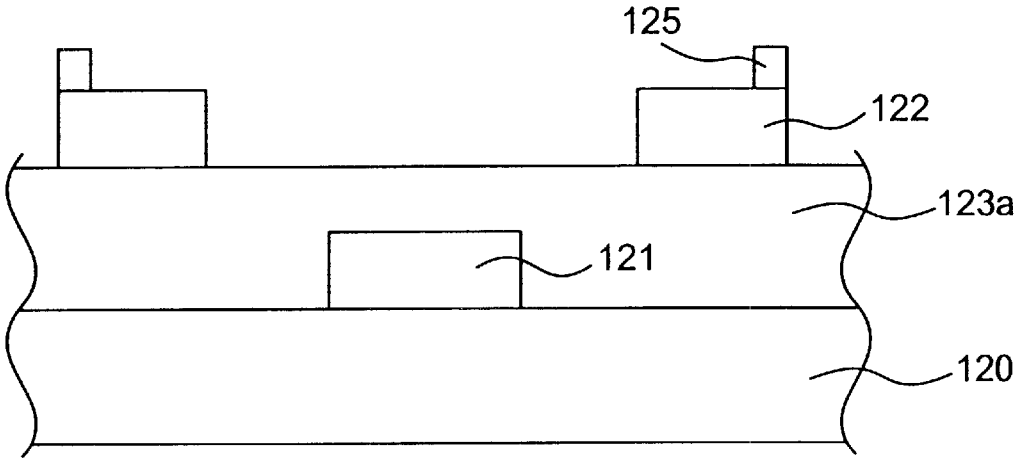
Figure 12D:
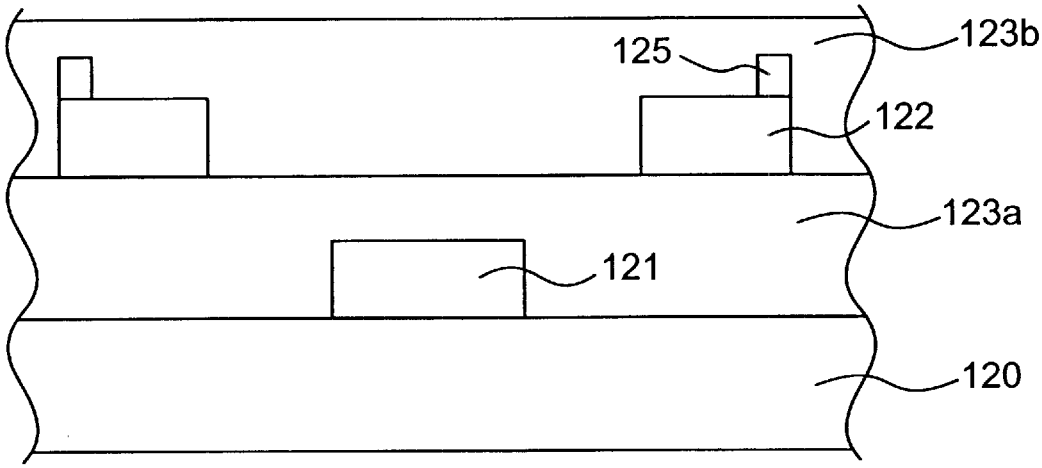

Initially referring to FIG. 12A, a first electrode 121 for addressing the pixel is formed on a front glass substrate 120. The first electrode 121 may be formed of indium tin oxide (ITO). In FIG. 12B, a first transparent dielectric layer 123*a* is formed on the front substrate 120 including the first electrode 121. For example, a lead oxide (PbO) glass may be selected for the first transparent dielectric layer 123*a*. Then, as shown in FIG. 12C, a plurality of second electrodes 122, made of ITO, are formed on the first transparent dielectric layer 123*a*. Thereafter, a third electrode 125 acting as a bus electrode is formed on each of the second electrodes 122. For example, the third electrode 125 may be formed of silver (Ag) and has a line width of about 50 $\mu$m. In FIG. 12D, a second transparent dielectric layer 123*b* is formed on the second electrodes 122, the third electrode 125, and the first dielectric layer 123*a*.

Figure 12E:
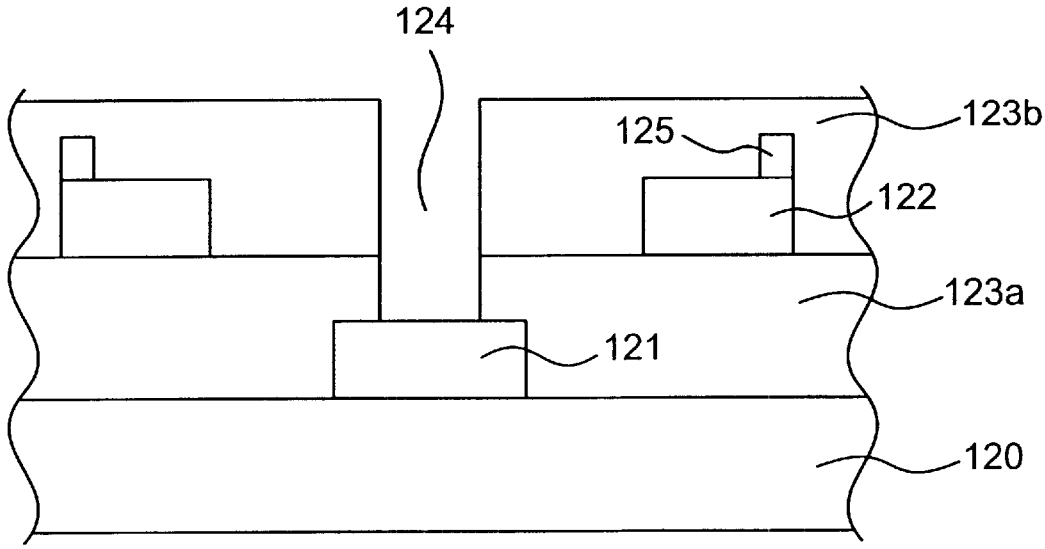

In FIG. 12E, at least one capillary 124 is formed in the first and second dielectric layers 123*a* and 123*b* by laser machining or etching to expose the first electrode 121 to the discharge chamber (not shown). A screen printing process or a sputtering method may be used to form various electrodes and layers.

Figure 13:
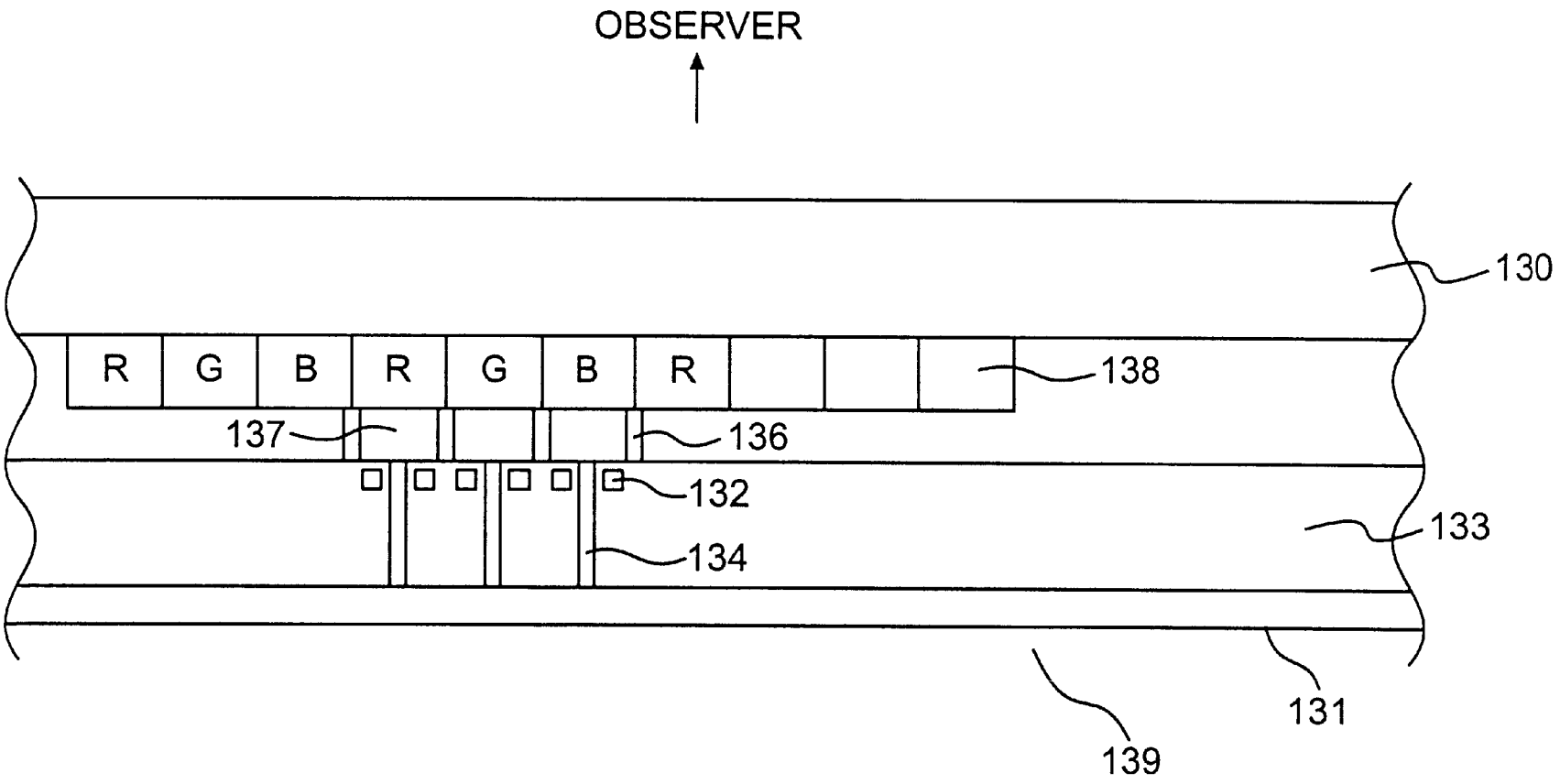
FIG. 13 is a cross-sectional view of a plasma display panel device according to a seventh embodiment of the present invention.

FIG. 13 illustrates a cross-sectional view of a PDP device according to a seventh embodiment of the present invention. Unlike all of the previous embodiments, the seventh embodiment of the present invention is a transmissive type plasma display panel device. Thus, an observer can enjoy the picture generated on the viewing panel having a UV-visible conversion layer. More specifically, as shown in FIG. 13, a UV-visible photon conversion layer 138 for presenting R, G, B pixels is formed on a front glass substrate 130. A first electrode 131, formed of aluminum (Al), is deposited on a back substrate 139 to reflect photo-emissions to the viewing panel (front glass substrate 130). A dielectric layer 133 is formed on the first electrode 131. A plurality of second electrodes 132 are formed in the dielectric layer 133. A pair of barrier ribs 136 connect the front and back substrates and define a discharge chamber 137 between the front and back substrates 130 and 139. At least one capillary 134 is formed in the dielectric layer 133 and exposes the first electrode 131 to the discharge chamber 137.

Figure 14:
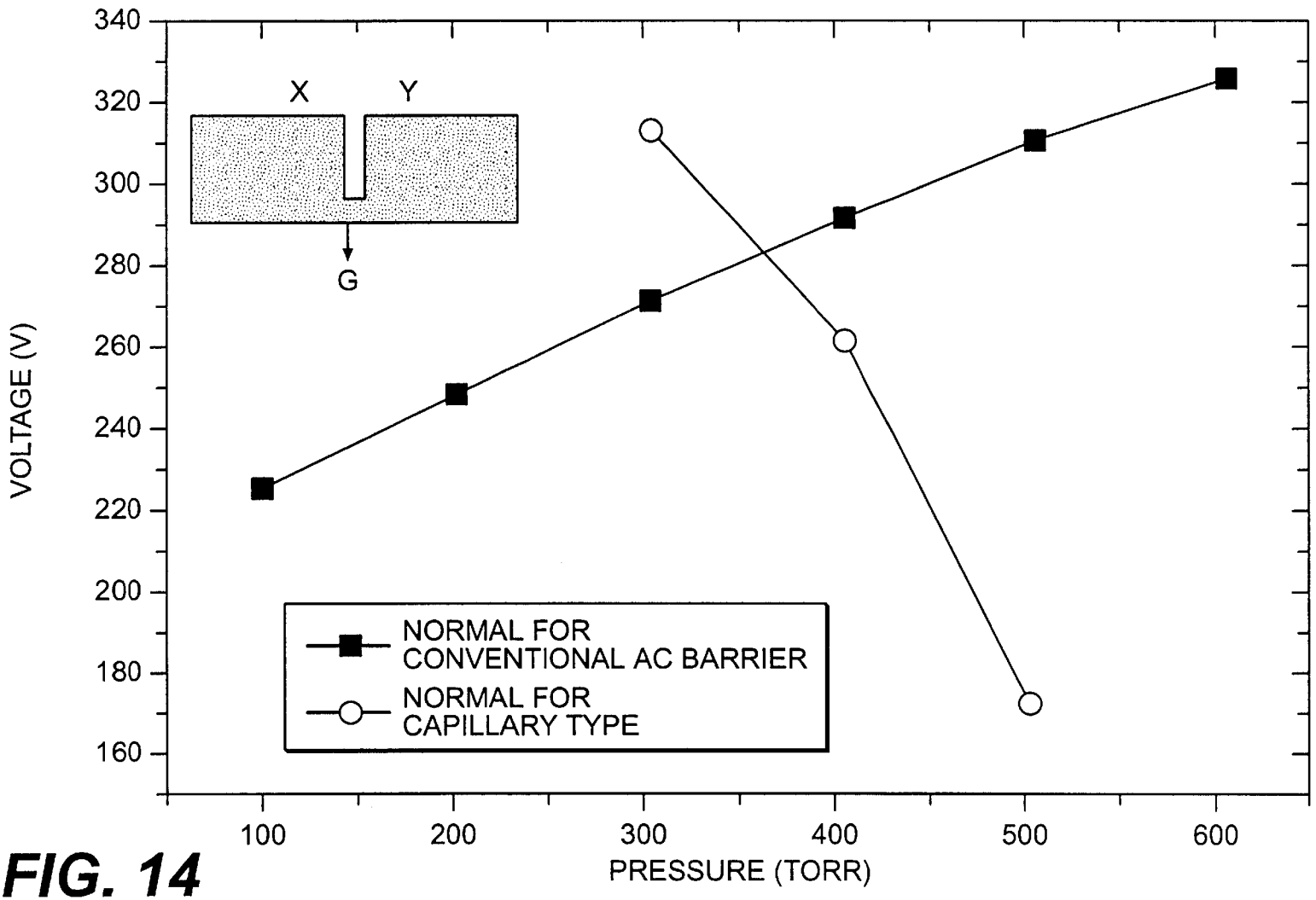
FIG. 14 is a graph illustrating relationships between a driving voltage and a discharge chamber gas pressure for the conventional AC barrier type PDP device and a capillary type PDP device of the present invention.

FIG. 14 illustrates a relationship between a discharge operation voltage and a pressure in the discharge chamber of the conventional AC barrier type PDP device (solid squares) and the capillary type PDP device of the present invention (open circles). As shown in FIG. 14, for the capillary type PDP device of the present invention, the discharge operation voltage of the device decreases as the pressure increases in the range of about 300 Torr and 760 Torr, while the driving voltage of the device increases as the pressure increases for the conventional the AC barrier type PDP. As a result, the capillary type PDP device of the present invention does not require a higher discharge operation voltage even if the pressure of the device is increased.

Figure 15:
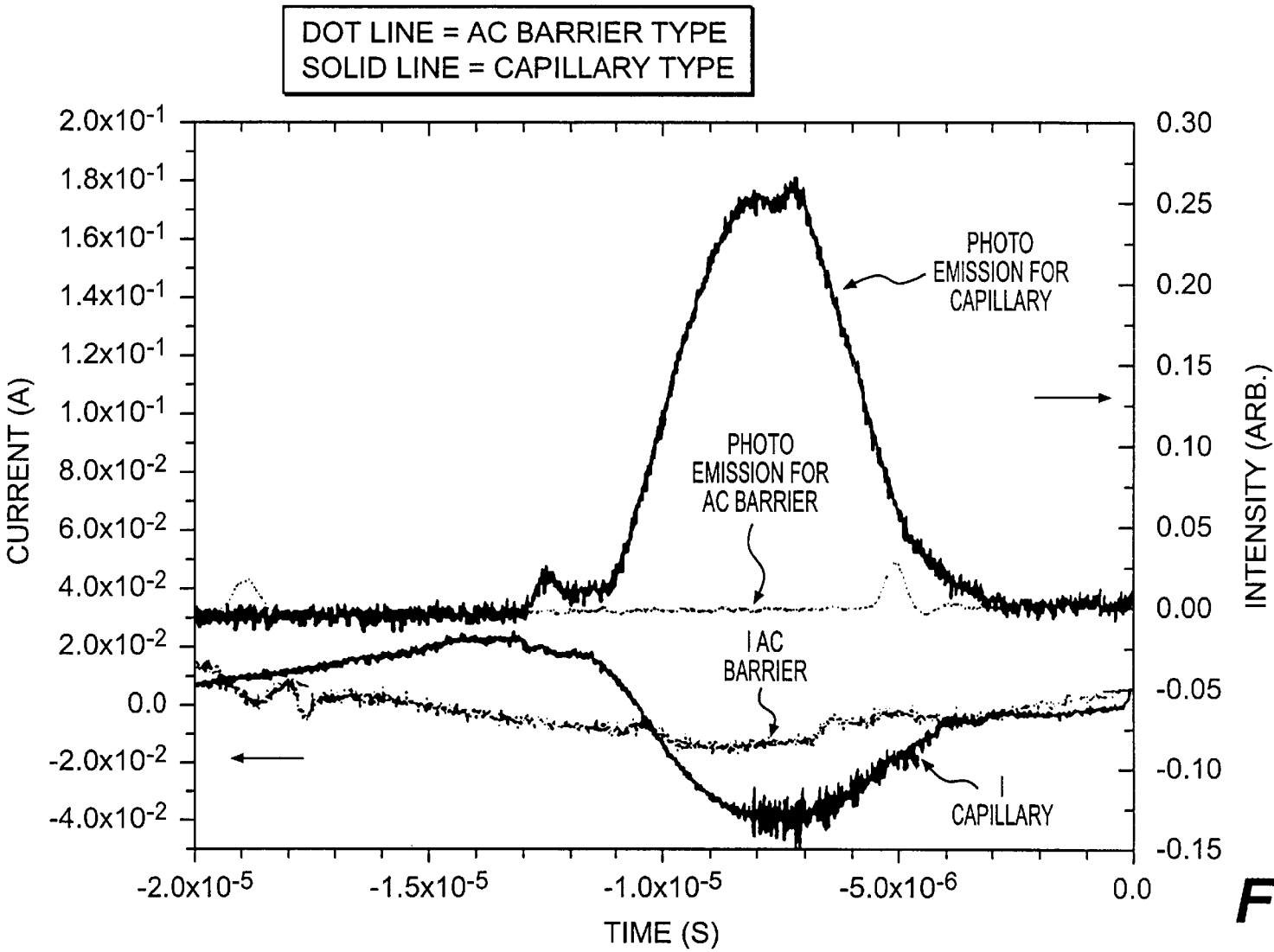
FIG. 15 is spectra illustrating relative photo-emission intensities for the conventional AC barrier type PDP device and the capillary type PDP device of the present invention at the same driving voltage.

FIG. 15 is spectra illustrating relative photo-emission intensities for the conventional AC barrier type PDP (dotted line) and the capillary type PDP (solid line) of the present invention at the same driving voltage. The intensity of the capillary type PDP device of the present invention is much higher than that of the AC barrier type PDP device under the same driving voltage.

Figure 16:
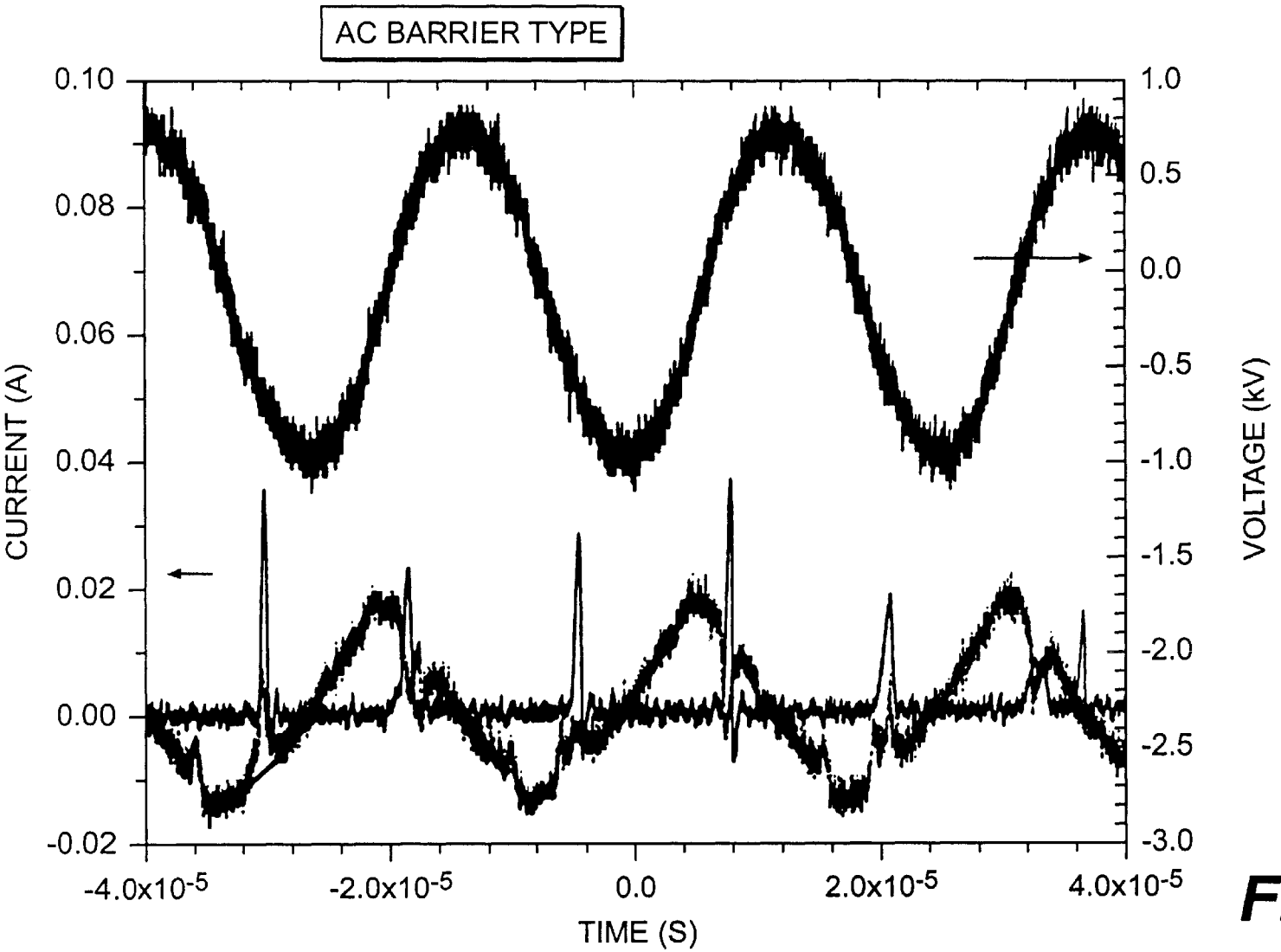
FIG. 16 is spectra illustrating relative intensities for current and photo-emission at a fixed AC voltage for the conventional AC barrier type PDP device.
Figure 17:
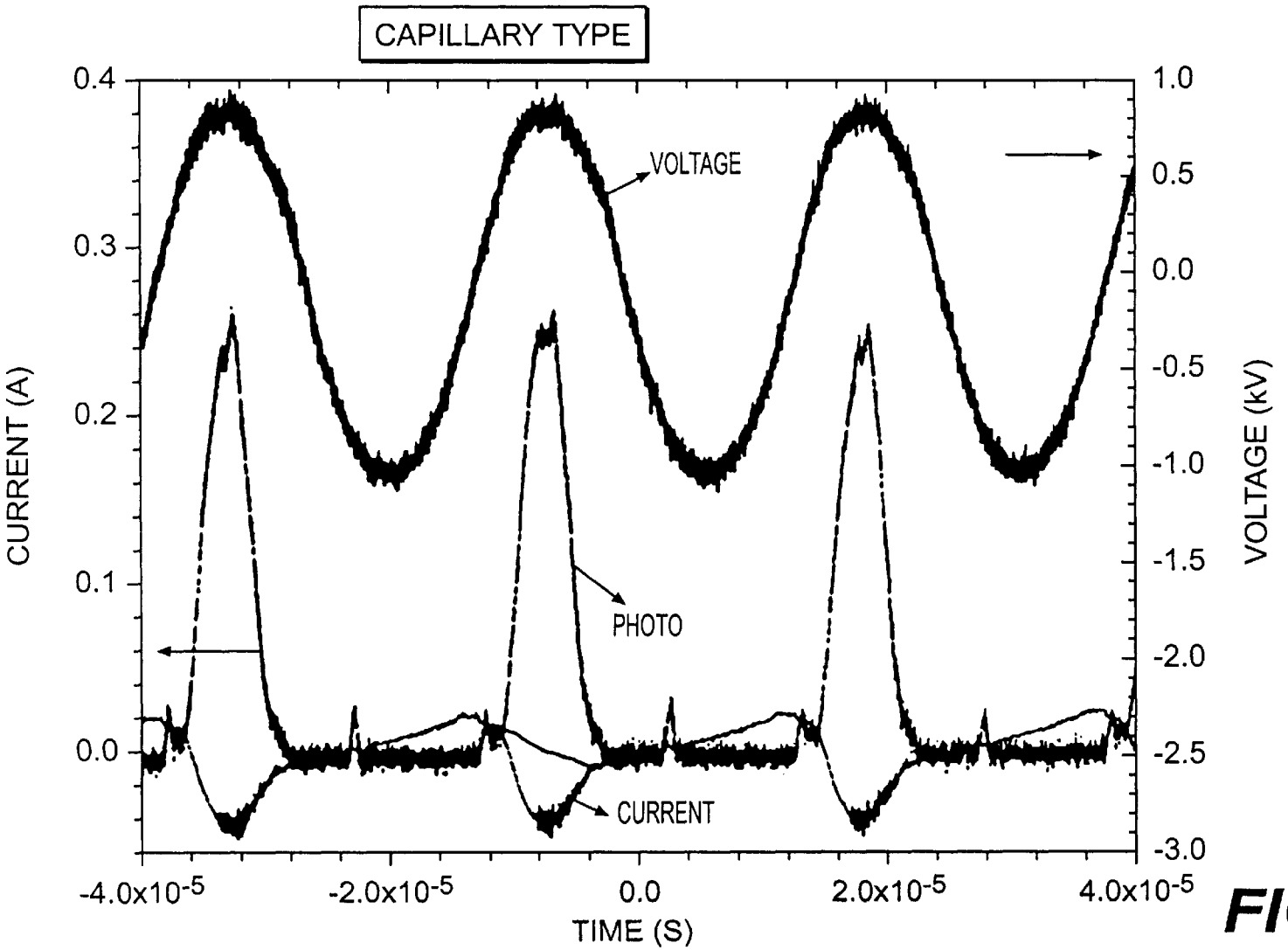
FIG. 17 is spectra showing relative intensities for current and photo-emission at a fixed AC voltage for the capillary type PDP device of the present invention.

FIGS. 16 and 17 are spectra illustrating relative intensities for current and photo-emission at a fixed AC voltage for the conventional AC barrier type PDP and the capillary type PDP of the present invention, respectively. The current and photo-emission intensities of the capillary type PDP device of the present invention are much higher than those of the AC barrier type PDP device at the same AC voltage.

As discussed above, a plasma display panel device and method of fabricating the same of the present invention has the following advantages.

According to the present invention, the field in the capillary does not collapse. Thus, a high electric field discharge is maintained in the capillary. As a result, much enhanced brightness is obtained in the PDP device of the present invention. Also, the PDP device of the present invention does not require a higher driving voltage as the pressure in the discharge chamber increases up to the atmospheric pressure.

In addition, the PDP device of the present invention is capable of being operated in both an AC and DC mode and has an address voltage of 50 to 250 V, which is much smaller than that of the conventional PDP device. This is because a breakdown voltage is lowered by using a large field across the dielectric layer in the early phase of a cycle for generating electron avalanches in the capillary.

A structure of the PDP device of the present invention is simpler than that of the conventional DC PDP device since a current limiting resistor on the dielectric layer is necessary for the present invention.

Further, unlike the conventional PDP device, a response time is very short because a time for dielectric charging is eliminated from the response time.

Accordingly, the present invention has a high efficiency in generating a steady state high density UV emission.

It will be apparent to those skilled in the art that various modifications and variations can be made in a plasma display panel device and method of fabricating the same of the present invention without departing from the spirit or scope of the invention. Thus, it is intended that the present invention cover the modifications and variations of this invention provided they come within the scope of the appended claims and their equivalents.

What is claimed is:

1. A plasma display panel device, comprising:

first and second substrates;

a first electrode on the first substrate;

a second electrode on the second substrate;

a dielectric layer on the second substrate including the second electrode;

a plurality of third electrodes completely buried in the dielectric layer;

a plurality of barrier ribs connecting the first and second substrates formed on the second substrate;

a UV-visible conversion layer on the second substrate including the second substrate between the barrier ribs; and a discharge chamber where discharge occurs between the first and second substrates, wherein the discharge chamber faces toward the second electrode through a single row of one or more capillaries formed in the dielectric layer.

2. The plasma display panel device according to claim 1, wherein the first electrode is to bias the discharge to a viewing direction.

3. The plasma display panel device according to claim 1, wherein the second electrode includes an address electrode.

4. The plasma display panel device according to claim 1, wherein the third electrodes include sustain electrodes.

5. The plasma display panel device according to claim 1, further comprising a fourth electrode on each of the third electrodes in the dielectric layer.

6. The plasma display panel device according to claim 5, wherein the fourth electrode includes a bus electrode.

7. The plasma display panel device according to claim 6, wherein the bus electrode is formed of silver.

8. The plasma display panel device according to claim 6, wherein the bus electrode has a line width of about 50 μm.

9. The plasma display panel device according to claim 1, wherein the capillaries are formed between each of the third electrodes.

10. The plasma display panel device according to claim 1, wherein the capillaries are formed in every other portion between each of the third electrodes.

11. The plasma display panel device according to claim 1, wherein a diameter of the capillaries is in the range of 10 to 500 μm.

12. The plasma display panel device according to claim 1, wherein the number of the capillaries per pixel is up to 3.

13. The plasma display panel device according to claim 1, wherein each edge portion of the capillaries adjacent to the discharge chamber forms a curvature.

14. The plasma display panel device according to claim 1, wherein a width of the second electrode (d1) is in the range of 0.01 μm to a maximum unit cell pitch (D), and a width of the third electrode (d2) is between 0.01 μm and (D-d4)/2.

15. The plasma display panel device according to claim 14, wherein a gap between two adjacent third electrodes (d4) is between d3 and (D−2×d2), where d3 is a diameter of each capillary.

16. The plasma display panel device according to claim 1, wherein a thickness of the second electrode is in the range of 0.01 μm to 20 μm.

17. The plasma display panel device according to claim 1, wherein the dielectric layer is formed of lead oxide (PbO) glass.

18. The plasma display panel device according to claim 1, wherein the third electrodes are formed of indium tin oxide.

19. The plasma display panel device according to claim 1, wherein the UV visible photon conversion layer includes a phosphor layer.

20. The plasma display panel device according to claim 1, wherein the first, second, and third electrodes are capable of being driven by both AC and DC voltages.

21. The plasma display panel device according to claim 1, wherein the discharge is generated by applying an address voltage in the range of 50 to 250 V.

22. The plasma display panel device according to claim 21, wherein the discharge operation voltage decreases when a pressure in the discharge chamber increases in the range of 300 to 760 Torr.

23. A plasma display panel device comprising:

first and second substrates;

a first electrode on the first substrate;

a second electrode on the second substrate;

a dielectric layer on the second substrate including the second electrode;

a plurality of third electrodes on the dielectric layer;

a discharge chamber where discharge occurs between the first and second substrates, wherein the discharge chamber is exposed to a single row of one or more capillaries formed in the dielectric layer; and a protective layer on the third electrodes and the dielectric layer including on a portion of the dielectric layer in the capillaries.

24. The plasma display panel device according to claim 23, wherein the dielectric layer is formed of lead oxide (PbO) glass.

25. The plasma display panel device according to claim 23, wherein the first, second, and third electrodes are capable of being driven by both AC and DC voltages.

26. The plasma display panel device according to claim 23, wherein the discharge is generated by applying an address voltage in the range of 50 to 250 V.

27. The plasma display panel device according to claim 26, wherein the discharge operation voltage decreases when a pressure in the discharge chamber increases in the range of 300 to 760 Torr.

28. The plasma display panel device according to claim 23, wherein the second electrode is exposed to the discharge chamber through the capillaries.

29. The plasma display panel device according to claim 28, further comprising a fourth electrode adjacent to the second electrode and surrounding the capillaries.

30. A transmissive type plasma display panel device comprising:

first and second substrates, the second substrate being a viewing panel;

a first electrode on the first substrate;

a UV-visible conversion layer on the second substrate;

a dielectric layer on the first electrode;

a plurality of second electrodes completely buried in the dielectric layer; and a discharge chamber where discharge occurs between the first and second substrates, wherein the discharge chamber faces toward the first electrode through a single row of one or more capillaries formed in the dielectric layer.

31. The plasma display panel device according to claim 30, wherein the first electrode is formed of aluminum for reflecting the discharge to the second substrate.

32. The plasma display panel device according to claim 30, wherein the first and second electrodes are capable of being driven by both AC and DC voltages.

33. The plasma display panel device according to claim 30, wherein the discharge is generated by applying an address voltage in the range of 50 to 250 V.

34. The plasma display panel device according to claim 33, wherein the discharge operation voltage decreases when a pressure in the discharge chamber increases in the range of 300 to 760 Torr.

35. A method of fabricating a plasma display panel device having first and second substrates, comprising the steps of:

forming a first electrode on the first substrate;

forming a second electrode on the second substrate;

forming a first dielectric layer on the second substrate including the second electrode;

forming a plurality of third electrodes on the first dielectric layer;

forming a second dielectric layer on the first dielectric layer including the third electrodes;

forming a single row of one or more capillaries in the first and second dielectric layers; and forming a plurality of barrier ribs on the first substrate connecting the first and second substrates, thereby forming a discharge chamber between the first and second substrates defined by the barrier ribs.

36. The method according to claim 35, wherein the step of forming a single row of one or more capillaries is performed by laser machining or etching.

37. The method according to claim 35, wherein a diameter of each of the capillaries is in the range of 10 to 500 μm.

38. The method according to claim 35, wherein the single row of the capillaries per pixel has up to 3 capillaries.

39. The method according to claim 35, wherein the discharge chamber faces toward the second electrode through the capillaries.

40. The method according to claim 35, further comprising the step of forming a fourth electrode surrounding the capillaries formed in the first dielectric layer on the second substrate.

41. The method according to claim 35, wherein the capillaries are formed between each of the third electrodes.

42. The method according to claim 35, wherein the capillaries are formed in every other portion between the each of the plurality of third electrodes.

43. The method according to claim 35, wherein each edge portion of the capillaries adjacent to the discharge chamber forms a curvature.

44. The method according to claim 35, wherein a width of the second electrode (d1) is in the range of 0.01 $\mu$m to a maximum unit cell pitch (D), and a width of the third electrode (d2) is between 0.01 $\mu$m and (D−d4)/2.

45. The plasma display panel device according to claim 44, wherein a gap between two adjacent third electrodes (d4) is between d3 and (D−2×d2), where d3 is a diameter of each capillary.

46. The plasma display panel device according to claim 44, wherein a thickness of the second electrode is in the range of 0.01 $\mu$m to 20 $\mu$m.

47. The method according to claim 35, further comprising the step of forming a fifth electrode on each of the third electrodes before the step of forming a second dielectric layer.

48. The method according to claim 47, wherein the fifth electrode is a bus electrode.

49. The method according to claim 48, wherein the bus electrode is formed of silver and has a line width of about 50 $\mu$m.

50. The method according to claim 35, wherein the first and second dielectric layers are transparent.

51. The method according to claim 35, wherein the first and second dielectric layers are formed of lead oxide (PbO) glass.

52. The method according to claim 35, wherein the third electrodes are formed of indium tin oxide.

53. The method according to claim 35, further comprising the step of forming a UV-visible photon conversion layer on the first electrode.

54. The plasma display panel device according to claim 35, wherein the first, second, and third electrodes are capable of being driven by both AC and DC voltages.

55. The plasma display panel device according to claim 35, wherein the discharge is generated by applying an address voltage in the range of 50 to 250 V.

56. The plasma display panel device according to claim 55, wherein the discharge operation voltage decreases when a pressure in the discharge chamber increases in the range of 300 to 760 Torr.

* * * * *